US005893327A

United States Patent [19]

Dengel et al.

[11] Patent Number: 5,893,327

[45] Date of Patent: Apr. 13, 1999

[54] INKING UNIT FOR A ROTARY PRINTING PRESS

[75] Inventors: Uwe Dengel, Dielheim; Peter Heiler, Forst, both of Germany

[73] Assignee: Heidelberger Druckmaschinen AG, Heidelberg, Germany

[21] Appl. No.: 09/045,206

[22] Filed: Mar. 20, 1998

[30] Foreign Application Priority Data

Mar. 20, 1997 [DE] Germany ..... 197 11 545.4

[51] Int. Cl.[6] ..... B41F 35/00

[52] U.S. Cl. ..... 101/424; 101/425

[58] Field of Search ..... 101/424, 425, 101/423; 15/256.5, 256.51, 256.52

[56] References Cited

U.S. PATENT DOCUMENTS

| | | | |
|---|---|---|---|
| 3,658,003 | 4/1972 | Johnson | 101/425 |
| 3,800,702 | 4/1974 | Roberts | 101/425 |
| 4,066,017 | 1/1978 | Garcowski et al. | 101/425 |
| 5,010,819 | 4/1991 | Uribe et al. | 101/425 |
| 5,328,511 | 7/1994 | Beisswanger | 15/256.51 |
| 5,365,849 | 11/1994 | Spiegel | 101/424 |
| 5,813,341 | 9/1998 | Tojima et al. | 101/423 |

FOREIGN PATENT DOCUMENTS

| | | |
|---|---|---|
| 0525586A1 | 2/1993 | European Pat. Off. . |
| 1133403 | 7/1962 | Germany . |
| 9212582 | 1/1993 | Germany . |
| 19501806A1 | 7/1996 | Germany . |
| 29609426U1 | 9/1996 | Germany . |
| 19511231A1 | 10/1996 | Germany . |
| 2270650 | 3/1994 | United Kingdom . |
| 2299300 | 10/1996 | United Kingdom . |

*Primary Examiner*—Edgar Burr
*Assistant Examiner*—Anthony H. Nguyen
*Attorney, Agent, or Firm*—Herbert L. Lerner; Laurence A. Greenberg

[57] ABSTRACT

An inking unit for a rotary printing press with inking rollers, at least one of which has a hard outer cylindrical surface, including a device having nozzles for applying fresh cleaning fluid onto the respective inking rollers and a device for squeegeeing cleaning fluid soiled with ink residues from the roller of the inking unit having the hard outer cylindrical surface, further includes a drip pan disposed beneath the nozzles and formed with a drain having a discharge end, the squeegeeing device being a doctor blade device and having assigned thereto a collection vessel wherein the drain discharge end terminates, the collection vessel being periodically removable from the printing press for emptying therefrom the collected cleaning fluid soiled with ink residues, and a follow-up trough assigned to the drain discharge end, the follow-up trough being swingable beneath the discharge end when the collection vessel is removed from the printing press.

5 Claims, 1 Drawing Sheet

INKING UNIT FOR A ROTARY PRINTING PRESS

BACKGROUND OF THE INVENTION

FIELD OF THE INVENTION

The invention relates to an inking unit for a rotary printing press with inking rollers, including a device for applying cleaner or cleaning fluid to the inking rollers and a device for squeegeeing cleaning fluid soiled with ink residues from a roller of the inking unit having a hard outer cylindrical surface, fresh cleaner being applied via nozzles onto the respective ink rollers.

The published German Patent Document DE 195 11 231 A1 discloses such an inking unit having nozzles which can spray different cleaners or cleaning media or also water via individual or separate feed pipes onto the rollers. If cleaning fluid which is slightly vaporizable is used with the conventional devices, the nozzles may drip, for example, when temperature variations occur. Because even the smallest quantities of the cleaning fluid can cause disruptions in the printing process, contamination of the inking rollers with washing or cleaning fluid should be avoided at all costs. In the heretofore known inking units, there has been no provision for reliably preventing washing or cleaning fluid from dripping on an inking roller at some time and causing a variation in the imprint.

SUMMARY OF THE INVENTION

Starting from this state of the art, it is an object of the invention to provide an inking unit for a rotary printing press which will reliably prevent the dripping of undesired washing or cleaning fluid on the inking rollers thereof.

With the foregoing and other objects in view, there is provided, in accordance with the invention, an inking unit for a rotary printing press with inking rollers, at least one of which has a hard outer cylindrical surface, including a device having nozzles for applying fresh cleaning fluid onto the respective inking rollers and a device for squeegeeing cleaning fluid soiled with ink residues from the roller of the inking unit having the hard outer cylindrical surface, comprising a drip pan disposed beneath the nozzles and formed with a drain having a discharge end, the squeegeeing device being a doctor blade device and having assigned thereto a collection vessel wherein the drain discharge end terminates, the collection vessel being periodically removable from the printing press for emptying therefrom the collected cleaning fluid soiled with ink residues, and a follow-up trough assigned to the drain discharge end, the follow-up trough being swingable beneath the discharge end when the collection vessel is removed from the printing press.

In accordance with another feature of the invention, the follow-up trough has a stop which, in the condition wherein the collection vessel is disposed in the printing press, is engageable with a cam formed on the collecting vessel so as to empty the follow-up trough into the collection vessel.

In accordance with a further feature of the invention, the follow-up trough is swingable beneath the drain discharge end under spring force and is controllable by the removal of the collection vessel from the printing press and the return thereof to the printing press.

In the case of the foregoing embodiment of the invention, if washing or cleaning fluid were to drip from the nozzles, it would initially be collected in the drip pan. An outlet or drain, which may be formed of a hose, for example, is provided for the drip pan, so that the drip pan has to receive only a small amount of the washing or cleaning fluid before there is a danger of overflow thereof. Following the installation of the collection vessel during the operation of the printing press, in order to be able to collect the squeezed or scraped off soiled cleaning fluid for effecting the often automatically performed wash cycles, the dripped-off cleaning fluid passes with the soiled cleaning fluid directly into the collection vessel. If the pressman has removed the collection vessel provided in accordance with the invention from the printing press, however, for example, in order to empty or clean it, the follow-up trough is then swung beneath the drain discharge end and can collect the quantity of resulting dripped-off cleaning fluid until the drain collection vessel is reinstalled. As the collection vessel is being reinstalled or reinserted into the printing press, it causes the follow-up trough to swing away and simultaneously empties it.

By providing the stop on the follow-up trough, reliable inward and outward swinging of the follow-up trough is assured. The application of spring force serves as a support or reinforcement for the inward swinging of the follow-up trough, it being conceivable, however, also to provide other force-applying devices such as pneumatic cylinders, or even force of gravity.

In accordance with an alternative feature of the invention, the inking unit includes a plug for stopping the drain discharge end.

In accordance with a concomitant feature of the invention, the plug is disposed in the follow-up trough.

The plug thus serves as a closure for the drain discharge end, so that the follow-up trough need only collect a very small amount of dripping cleaning fluid. The closure can be effected under spring force, for example, via a rubber seal. After the collection vessel has been reinstalled following a brief period of time, in order that it be available for the next washing or cleaning cycle, only a relatively short period of time is provided for the nozzles to drip so that only small accumulations of washing or cleaning fluid result which cannot cause any disturbance.

Other features which are considered as characteristic for the invention are set forth in the appended claims.

Although the invention is illustrated and described herein as embodied in an inking unit for a rotary printing press, it is nevertheless not intended to be limited to the details shown, since various modifications and structural changes may be made therein without departing from the spirit of the invention and within the scope and range of equivalents of the claims.

DESCRIPTION OF THE PREFERRED EMBODIMENTS

Figure 1:
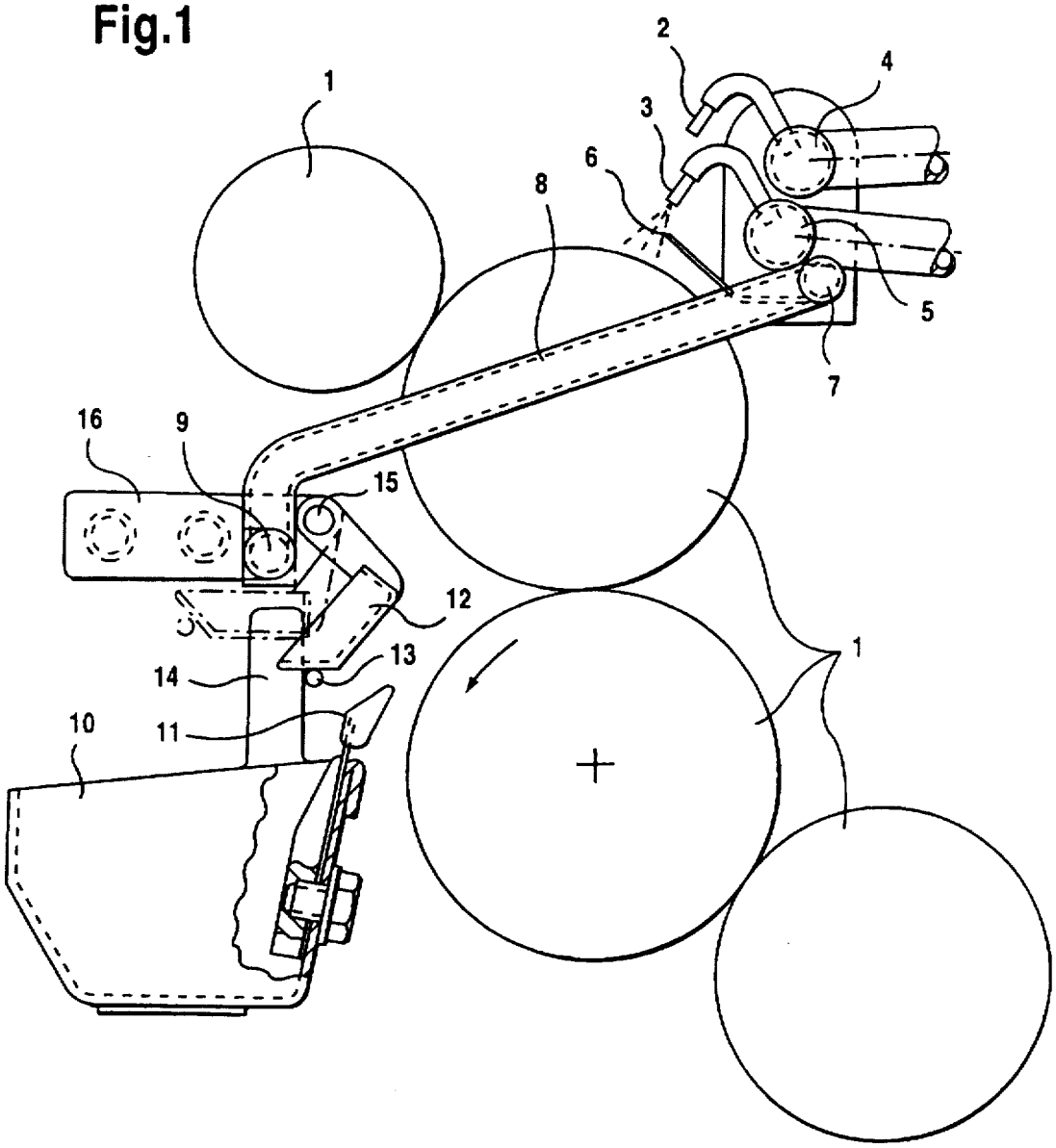
FIG. 1 is a diagrammatic side elevational view, partly in section and partly broken away, of one embodiment of the inking unit for a rotary printing press constructed in accordance with the invention.

Referring now to the drawing and, first, particularly to FIG. 1 thereof, there is shown therein a device for applying cleaner or cleaning medium to inking rollers 1 of an inking unit via nozzles 2 and 3 which are suppliable with the cleaner or cleaning medium via pipes 4 and 5. The cleaner can be sprayed in the form of various different cleaning fluids through the nozzles 2 and 3 onto the inking rollers 1 in accordance with various different cleaning programs. A drip pan 6 is provided beneath the nozzles 2 and 3 for collecting cleaning fluid dripping therefrom. In this regard, the nozzles 2 and 3 and the drip pan 6 extend over the length of a respective inking roller 1. An outlet or drain 7, which may have a hose 8, for example, connected thereto, is provided in the drip pan 6. The hose 8 extending from the drain 7 terminates at a location 9 at which the collected cleaning fluid is discharged into a collection vessel 10 of a doctor blade device 11. After cleaning fluid has been sprayed on the inking roller 1, the doctor blade device 11 is swung towards the outer cylindrical surface thereof so as to squeeze or scrape soiled cleaning fluid therefrom, this having been advantageously performed on an inking roller having a hard outer cylindrical or casing surface. Moreover, the squeezing or scraping may be controlled automatically in accordance with respective cleaning cycles.

After a given operating period of the printing press, the pressman will remove the collection vessel 10 from the inking unit, for example, at a brief interruption of the printing process, in order to empty and clean it, the cleaning being performable in a relatively short period of time. For this period of time, a follow-up trough 12 is swung under the discharge location 9 of the outlet or drain 7, so that no cleaning fluid can reach the inking unit. In this regard, the follow-up trough 12 has a stop 13 which engages a cam or dog 14 on the collection vessel 10 during the operation of the printing press. When the collection vessel 10 is removed, the follow-up trough 12 swings into the position thereof represented in phantom in the figure, and collects any subsequently dripping cleaning fluid. The instant the collection vessel 10 with the doctor blade device 11 is again introduced into the inking unit, the cam or dog 14 presses the follow-up trough 12 via the stop 13 into the position thereof represented by solid and broken lines in the figure, so that the follow-up trough 12 is emptied. The swinging movement of the follow-up trough 12 can be effected under spring force, by assigning to a pivot pin 15, a torsion spring, for example, which is braced against a bearing member 16.

Figure 2:
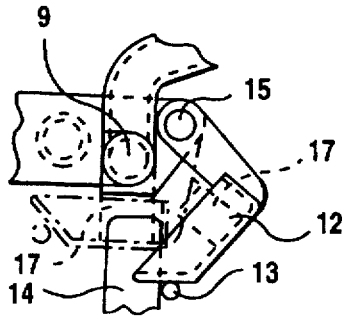
FIG. 2 is a fragmentary view of FIG. 1 showing, in part, another embodiment of the invention.

As shown in FIG. 2 as an alternative to the foregoing construction, a stopper-shaped plug 17, for example, can be provided in the follow-up trough 12 for closing the discharge end 9 of the outlet or drain 7 when the collection vessel 10 is removed, thereby preventing any of the dripped cleaning fluid from flowing off during the brief period of time in which the collection vessel 10 has been removed.

We claim:

1. An inking unit for a rotary printing press with inking rollers, at least one of which has a hard outer cylindrical surface, including a device having nozzles for applying fresh cleaning fluid onto the respective inking rollers and a device for squeegeeing cleaning fluid soiled with ink residues from the roller of the inking unit having the hard outer cylindrical surface, comprising a drip pan disposed beneath the nozzles and formed with a drain having a discharge end, the squeegeeing device being a doctor blade device and having assigned thereto a collection vessel wherein said drain discharge end terminates, said collection vessel being periodically removable from the printing press for emptying therefrom the collected cleaning fluid soiled with ink residues, and a follow-up trough assigned to said drain discharge end, said follow-up trough being swingable beneath said discharge end when said collection vessel is removed from the printing press.

2. The inking unit according to claim 1, wherein said follow-up trough has a stop which, in the condition wherein said collection vessel is disposed in the printing press, is engageable with a cam formed on said collecting vessel so as to empty said follow-up trough into said collection vessel.

3. The inking unit according to claim 1, wherein said follow-up trough is swingable beneath said drain discharge end under spring force and is controllable by the removal of said collection vessel from the printing press and the return thereof to the printing press.

4. The inking unit according to claim 2, including a plug for stopping said drain discharge end.

5. The inking unit according to claim 4, wherein said plug is disposed in said follow-up trough.

* * * * *